US008173921B2

(12) United States Patent
Watanabe

(10) Patent No.: US 8,173,921 B2
(45) Date of Patent: May 8, 2012

(54) SWITCH MODULE

(75) Inventor: Masashi Watanabe, Fujiyoshida (JP)

(73) Assignees: Citizen Electronics Co., Ltd., Yamanashi (JP); Citizen Holdings Co., Ltd., Tokyo (JP)

( * ) Notice: Subject to any disclaimer, the term of this patent is extended or adjusted under 35 U.S.C. 154(b) by 229 days.

(21) Appl. No.: 12/731,596

(22) Filed: Mar. 25, 2010

(65) Prior Publication Data

US 2010/0243417 A1 Sep. 30, 2010

(30) Foreign Application Priority Data

Mar. 25, 2009 (JP) ..... 2009-073002

(51) Int. Cl.
*H01H 9/00* (2006.01)

(52) U.S. Cl. ..... 200/311

(58) Field of Classification Search ..... 200/310–314, 200/317, 512–520, 5 A, 341, 237, 344, 406
See application file for complete search history.

(56) References Cited

U.S. PATENT DOCUMENTS

| | | | | |
|---|---|---|---|---|
| 7,671,289 | B2 * | 3/2010 | Matsukawa et al. | 200/313 |
| 2008/0237011 | A1 * | 10/2008 | Lee et al. | 200/314 |
| 2008/0257699 | A1 * | 10/2008 | Sung | 200/314 |

FOREIGN PATENT DOCUMENTS

| | | |
|---|---|---|
| JP | 2004069751 | 3/2004 |
| JP | 2004227997 | 8/2004 |

* cited by examiner

*Primary Examiner* — Edwin A. Leon
(74) *Attorney, Agent, or Firm* — Browdy and Neimark, PLLC

(57) ABSTRACT

A switch module includes a substrate (4), a plurality of switches (6) provided on an upper surface of the substrate (4), first and second light-guiding sheets (8, 10) disposed to be stacked above the plurality of switches (6), at least one first light source (12) disposed on the upper surface of the substrate (4) to illuminate the first light-guiding sheet (8), at least one second light source (14) disposed on the upper surface of the substrate (4) to illuminate the second light-guiding sheet (10), and a switching-control device (15) configured to switch between lighting of the first light source (12) and lighting of the second light source (14). First and second displays (22, 24) are respectively provided on a surface of each of the first and second light-guiding sheets (8, 10). When the first light source (12) is lighted, the first display is displayed, and when the second light source (14) is lighted, the second display (24) is displayed. By switching between lighting of the first light source (12) and lighting of the second light source (14), either the first display (22) or the second display (24) can be selectively displayed.

19 Claims, 7 Drawing Sheets

SWITCH MODULE

CROSS-REFERENCE TO THE RELATED APPLICATION

The application is based on and claims the priority benefit of Japanese Patent Application No. 2009-73002, filed on Mar. 25, 2009, the entire descriptions of which are incorporated herein by reference.

BACKGROUND OF THE INVENTION

1. Field of the Invention

The present invention relates to a switch module that generates an operation signal when the switch module is activated, and more specifically to a switch module that illuminates an operation portion or operation buttons of a keypad, a numerical keypad, an operation keyboard or the like in electronic devices such as mobile phones, mobile information terminals or the like.

2. Description of the Related Art

There is conventionally known a switch module, which is disclosed in FIG. 6 of the Japanese Patent Application Publication No. 2004-69751, for example. The switch module includes a substrate 63, a plurality of fixed contacts 62 provided on the substrate, a movable switch 64 comprising a tact spring disposed to cover each of the fixed contacts, a light-guiding sheet 21 disposed above the tact springs, and light sources 26 disposed to face an end of the light-guiding sheet 21. The switch module includes a plurality of key tops 65 each having a character printed thereon and is provided above the light-guiding sheet 21. In the switch module, each key top can easily be discriminated by illuminating light emitted from the light-guiding sheet to a character printed on each key top.

There is also known a switch module 1 including a detection panel 2 which is disposed upwardly and has a plurality of input areas T1 to T4, a display sheet 3 which is disposed under the detection panel 2 and has displays S1 to S5, and a light-guiding sheet 5A disposed under the display sheet 3 (for reference, see Japanese Patent Application Publication No. 2004-227997 (FIG. 2)). In the switch module, the detection panel 2, the display sheet 3 and the light-guiding sheet 5A are stacked, and each of the displays is discriminated by illuminating the display sheet 3 by the light-guiding sheet 5A.

However, in the aforementioned conventional switch module where the characters printed on the key top are lighted, there is a structure in which a plurality of characters or numbers for which switching character input modes is necessary are displayed on one key. In this case, there is a problem that it is not possible to determine which display corresponds to an operated key by only viewing the key top.

On the other hand, in the aforementioned conventional switch module in which the detection panel is placed on the display sheet, even if the input areas can be discriminated, it is not possible to obtain a good handling feeling when operating the display sheet because the detection panel is placed upon the display sheet, although the inputting areas can be clearly recognized.

SUMMARY OF THE INVENTION

An object of the present invention is to provide a switch module with clicking switches and easily recognizable marks of displays above the switches.

To achieve the object, a switch module according to an embodiment of the present invention includes a substrate having an upper surface, a plurality of switches provided on the upper surface of the substrate, a first light-guiding sheet that includes an upper surface, a lower surface, and a peripheral edge between the upper surface and the lower surface, the first light-guiding sheet that is disposed above the plurality of switches, a second light-guiding sheet having an upper surface, a lower surface, and a peripheral edge between the upper surface and the lower surface, the second light-guiding sheet that is layered above the first light-guiding sheet, at least one first light source disposed on the upper surface of the substrate to emit light into the first light-guiding sheet through the peripheral edge of the first light-guiding sheet, at least one second light source disposed on the upper surface of the substrate to emit light into the second light-guiding sheet through the peripheral edge of the second light-guiding sheet, and a illumination-control device switching on/off of the first light source and the second light source.

The switch module further includes a first display disposed adjacent to the first light-guiding sheet that guides light emitted from the first light source, and a second display disposed adjacent to the second light-guiding sheet that guides light emitted from the second light source. The first display is illuminated by guided light through the first light-guiding sheet, and the second display is illuminated by guided light through the second light-guiding sheet.

The first display may include a plurality of marks and the second display may include a plurality of marks that are different from the marks of the first display. Both of the marks of the first display and the second display are positioned above the respective switches.

The marks of the second display may be positioned above the marks of the first display, and each of the marks of the second display may include a light-diffusion layer that transmits light from the first light-guiding sheet that is positioned below the second display. In this configuration, the marks of the first display can be easily recognized when the first light source is turned on.

Each of the marks of the second display may be formed by a plurality of dots. In this configuration, the marks of the first display can be easily recognized through the second light-guiding sheet that is disposed above the first display, when the first light source is turned on.

At least one of the marks of the first display and at least one of the marks of the second display have an overlapped portion, and dots in the overlapped portion of the first display and the second display are displaced alternately in top plan view. In this configuration, the marks of the first display can be easily recognized through the second light-guiding sheet that is disposed above the first display, when the first light source is turned on.

Moreover, in consideration of an outer appearance of an electronic device in which the switch module is installed when the first and second light sources are not lighted, a colored layer having a high light-transmittance is provided on at least one of the upper surface and the lower surface of the second light-guiding sheet.

A filter may be provided on the upper surface of the second light-guiding sheet.

DETAILED DESCRIPTION OF THE PREFERRED EMBODIMENTS

Embodiments of the present invention will be described in detail hereinafter with reference to the accompanying drawings.

Figure 1:
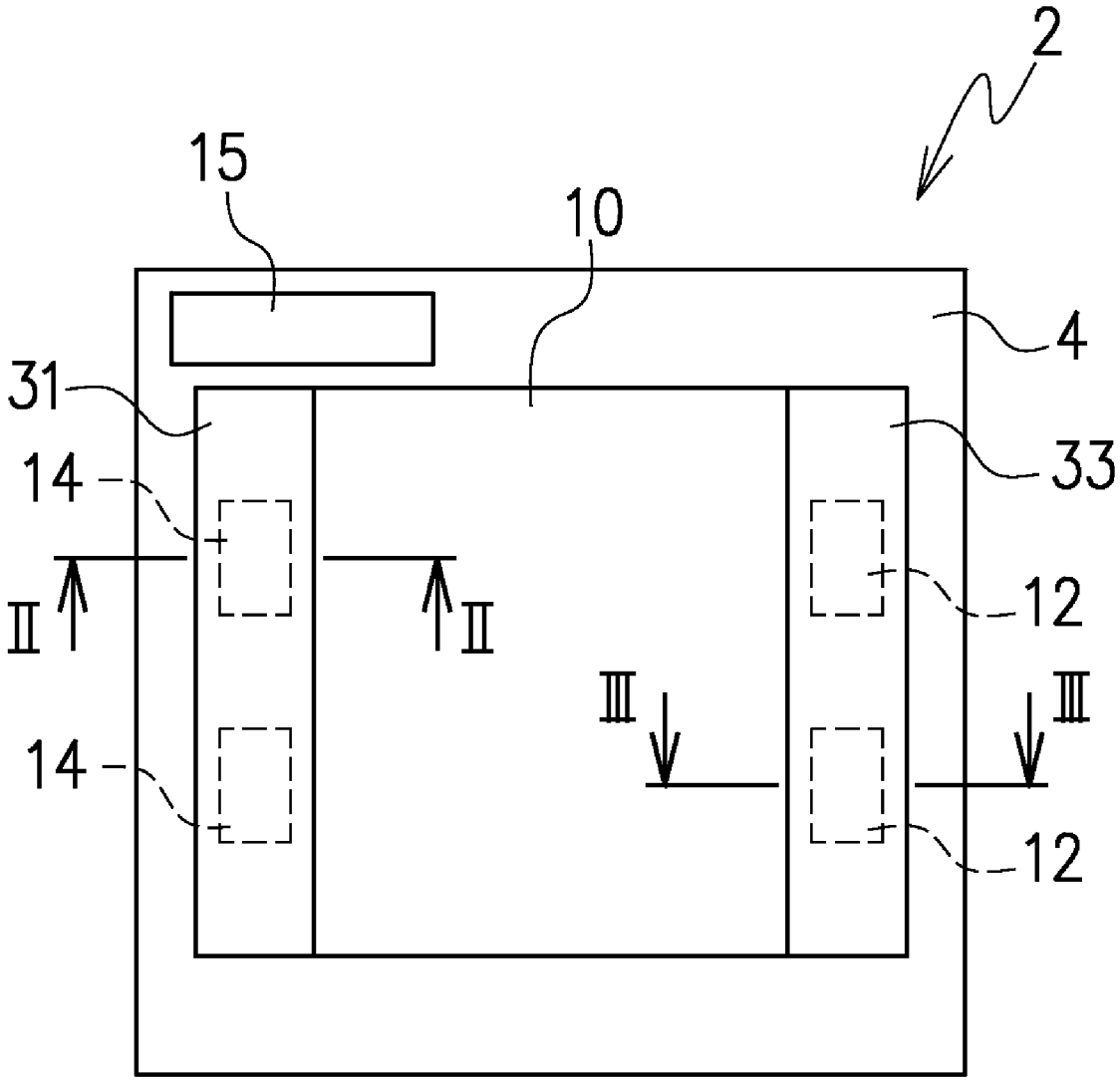
FIG. 1 is a top plan view showing a switch module according to one embodiment of the present invention.
Figure 2:
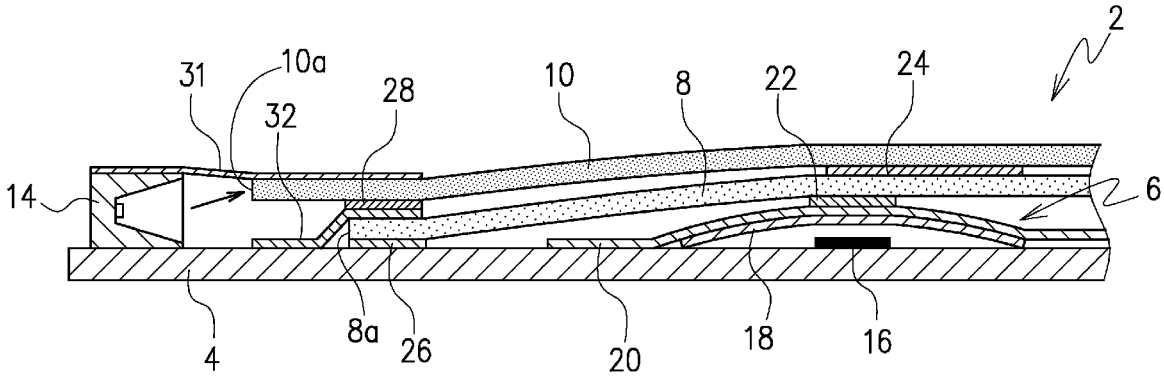
FIG. 2 is a sectional view taken along line II-II of the switch module shown in FIG. 1.
Figure 3:
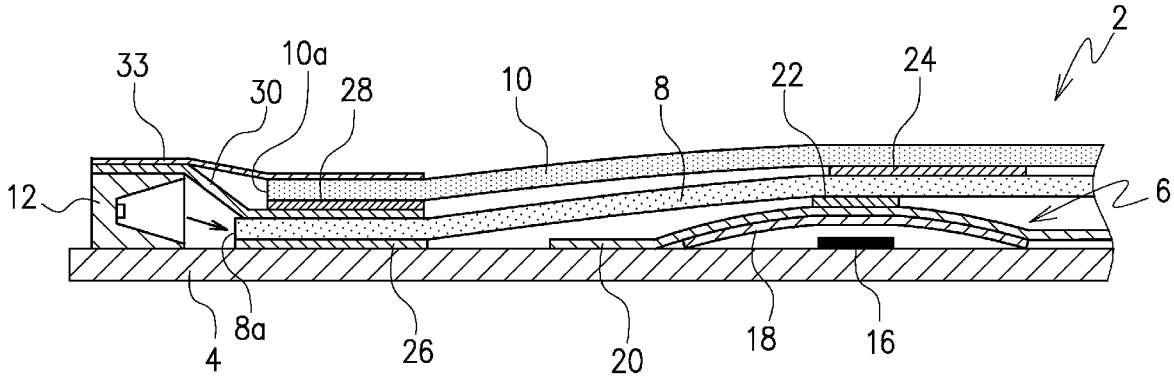
FIG. 3 is a sectional view taken along line III-III of the switch module shown in FIG. 1.

FIGS. 1 to 3 illustrate an embodiment of a switch module according to the present invention.

The switch module 2 in the embodiment includes a substrate 4, a plurality of switches 6 provided on a surface, for example, an upper surface of the substrate 4, a first light-guiding sheet 8 disposed above the switches 6, a second light-guiding sheet 10 disposed above the first light-guiding sheet 8, at least one first light source 12 disposed on the upper surface of the substrate 4 to illuminate the first light-guiding sheet 8, at least one second light source 14 disposed on the upper surface of the substrate 4 to illuminate the second light-guiding sheet 10, and a switching-control device 15 configured to switch between lighting of the first light source 12 and lighting of the second light source 14 (see FIGS. 1 to 3).

The first light-guiding sheet 8 includes an upper surface, a lower surface and a peripheral edge provided between the upper and lower surfaces, and the second light-guiding sheet 10 includes an upper surface, a lower surface and a peripheral edge provided between the upper and lower surfaces. The first and second light-guiding sheets 8 and 10 are adjacently layered. In the embodiment, the second light-guiding sheet 10 is adjacently layered above the first light-guiding sheet 8.

The at least one first light source 12 includes a light-emitting surface disposed to face a portion 8*a* of the peripheral edge of the first light-guiding sheet 8 to emit light into the first light-guiding sheet through the peripheral edge of the first light guiding sheet. The first light-guiding sheet 8 guides the received light from the first light source. A first display 22 is disposed adjacent to the first light-guiding sheet 8 that guides light emitted from the first light source. The at least one second light source 14 includes a light-emitting surface disposed to face a portion 10*a* of the peripheral edge of the second light-guiding sheet 10 to emit light into the second light guiding sheet through the peripheral edge of the second light-guiding sheet. A second display 24 is disposed adjacent to the second light-guiding sheet 10 that guides light emitted from the second light source In this embodiment, the first display includes a plurality of marks and the second display 24 includes a plurality of marks that are different from the marks of the first display (see FIGS. 4 and 5). "Marks" here mean numbers, characters, symbols that are necessary to be displayed above switches. Both of the marks of the first display and the second display are positioned above the respective switches.

Meanwhile, in the embodiment, a plurality of first light sources 12 and a plurality of second light sources 14 are disposed to face each other at opposite ends of the layered first and second light-guiding sheets (see FIG. 1).

An arrangement of the plurality of first light sources 12 and the plurality of second light sources 14 is described hereinafter.

Each of the plurality of switches 6 includes a fixed contact 16 disposed on the upper surface of the substrate 4, a tact spring 18 as a movable contact disposed on the upper surface of the substrate 4 to cover the fixed contact, and an adhesive sheet 20 that covers and holds the tact springs 18 of the switches, the adhesive sheet 20 having an adhesive surface covering the tact springs 18 and adhered to the upper surface of the substrate 4.

Each of the switches 6 has at least one operation position (not shown) provided above the corresponding fixed contact 16. By the operation position being pressed, the tact spring 18 as the movable contact is pressed to come in contact with the fixed contact 16 on the upper surface of the substrate 4 at a central portion of the tact spring 18 and configured to be separated from the fixed contact 16 when the operation position is released. The first display 22 including a plurality of marks and the second display 24 including a plurality of marks are positioned above the switches 6.

As mentioned above, the first displays 22 are disposed adjacent to the first light-guiding sheet 8, and illuminated by the guided light in the first light-guiding sheet 8. The second displays 24 are disposed adjacent to the second light-guiding sheet 10, and illuminated by the guided light in the second light-guiding sheet 10.

Here, an arrangement of the aforementioned component parts is described more specifically.

The marks of the first display 22 are disposed on the adhesive sheet 20 which is adhered onto the upper surface of the substrate 4 to cover the tact springs 18 of the plurality of switches 6, the first light-guiding sheet 8 is adjacently disposed above the first display 22 provided on the adhesive sheet 20 that covers the tact springs, the marks of the second display 24 are disposed on the upper surface of the first light-guiding sheet 8, and the second light-guiding sheet 10 is adjacently disposed above the second display 24 provided on the upper surface of the first light-guiding sheet 8.

When the switches 6 are provided and the first light-guiding sheet 8 and the second light-guiding sheet 10 are layered above the switches in this way, it is possible to reduce the entire thickness of the switch module because the first and second light-guiding sheets 8 and 10 each have a thin sheet form and the first and second displays 22 and 24 are thin layers such as a printing layer or the like.

The substrate 4 may be a flexible printed-circuit substrate or the like, the upper surface thereof being provided with a conductive pattern to which the fixed contacts 16 of the switches 6 are electrically connected.

Each of the first light-guiding sheet 8 and the second light-guiding sheet 10 is made of a material having a light-transmitting property such as acryl resin, silicone resin, polycarbonate resin, polyethylene terephthalate resin or the like and formed into a sheet having a predetermined thin thickness.

The marks of the first display 22 and the marks of the second display 24 are respectively provided at positions corresponding to each of the switches 6 and the marks of the first display 22 are illuminated by the light guided by the first light-guiding sheet 8 and the marks of the second display 24 are illuminated by the light guided by the second-light guiding sheet 10.

Each of the marks of the first display 22 may be a matte layer having concave-convex portions to diffuse light from the first light-guiding sheet or may be an opaque light-diffusion layer colored with diffusion white or other color. Each of the second displays 24 having a light-transmitting diffusion layer. The light-diffusion layer is, for example, formed by printing or the like.

The first light-guiding sheet 8 structured as mentioned above is fixed at a lower surface adjacent to a peripheral edge of the first light-guiding sheet to the upper surface of the substrate 4 by an adhesive layer 26 such as a double-faced tape, an adhesive or the like. The second light-guiding sheet 10 is fixed at a lower surface adjacent to a peripheral edge of the second light-guiding sheet to a surface of the first light-guiding sheet 10 by an adhesive layer 28 such as a double-faced tape, an adhesive or the like.

The plurality of first light sources 12 and the plurality of second light sources 14 comprise light-emitting elements such as LEDs (light emitting diodes) or the like and are arranged to face each other at opposite ends of the layered first and second light-guiding sheets, shown in FIGS. 1 to 3.

A light-emitting surface provided on each of the first light sources 12 is disposed to face the peripheral edge 8*a* of the first light-guiding sheet 8, and a light-emitting surface provided on each of the second light sources 14 is disposed to face the peripheral edge 10*a* of the second light-guiding sheet 10. Light emitted from the first light sources 12 enters the first light-guiding sheet 8 through the peripheral edge 8*a*, and light emitted from the second light source 14 enters the second light-guiding sheet 10 through the peripheral edge 10*a*. The first and second light-guiding sheets 8 and 10 guide the entered light from respective first and second light sources to illuminate the first and second displays 22 and 24, respectively.

In the embodiment, a first light-shielding sheet 30 is disposed above the first light sources 12 so that the light emitted from the first light sources 12 enters the first light-guiding sheet 8 securely without being directed to the second light-guiding sheet 10 (see FIG. 3), and a second light-shielding sheet 32 is disposed at a position adjacent to and opposite the second light sources 14 to cover the first light-guiding sheet 8 so that the light emitted from the second light sources 14 enters the second light-guiding sheet 10 securely without being directed to the first light-guiding sheet 8 (see FIG. 2).

More specifically, the first light-shielding sheet 30 have one end and an other end that is opposite to the one end, and the first light-shielding sheet 30 is adhered to an upper surface of the first light source at the one end and adhered to the upper surface of the first light-guiding sheet at the other end. The first light-shielding sheet 30 is disposed to bridge from an upper end portion of the light-emitting surface of each of the first light sources 12 to an upper end portion of the first light-guiding sheet 8 close to the peripheral edge 8*a* of the first light-guiding sheet 8. The provision of the first light-shielding sheet 30 prevents the light emitted from the first light sources 12 from entering the second light-guiding sheet 10, and the light emitted from the first light sources 12 just enter the peripheral edge 8*a* of the first light-guiding sheet 8.

On the other hand, the second light-shielding sheet 32 having one end and an other end that is opposite to the one end, and the second light-shielding sheet is adhered to the upper surface of the substrate at the one end and adhered to the upper surface of the first light-shielding sheet at the other end. The second light-shielding sheet 32 is disposed to bridge from the upper surface of the substrate 4 close to the light-emitting surface of each of the second light sources 14 to the lower surface of the second light-guiding sheet 10 close to the end surface of the light-guiding sheet 10, and thus, the light emitted from the second light sources 14 is blocked not to enter the first light-guiding sheet 8 and enters only the peripheral edge 10*a* of the second light-guiding sheet 10.

Note that in the embodiment, an end surface of the first light-shielding sheet 30 at the first light-guiding sheet 8 side and an end surface of the second light-shielding sheet 32 at the second light-guiding sheet 10 side are respectively held between the first and second light-guiding sheets 8 and 10 and adhered to them by an adhesive layer 28. In addition, other light-shielding sheet-like covers 31 and 33 are adhered to the uppermost second light-guiding sheet 10 to cover an area extending from upper portions of the first and second light sources 12 and 14 to peripheral edge portions of the first and second light-guiding sheets 8 and 10, in order to prevent light-emission from near the first and second light sources 12 and 14 in the first and second light-guiding sheets 8 and 10 from being seen.

Note that each of first light-shielding sheets 30 may be provided on each of the first light sources 12, and each of second light-shielding sheets 32 may be provided on each of the second light sources 14.

The illumination-control device 15 switches on/off of the first light source 12 and the second light source 14 in response to a switch operation or the like. The illumination-control device 15 includes, for example, a switch (not shown) and a control circuit (not shown) configured to control the first and second light sources 12 and 14 to light the first light sources 12, light the second light sources 14 by turning off the first light sources 12, or light the first and second light sources 12 and 14 together, in accordance with an operation of the switch.

The switching-control device 15 is provided on the upper surface of the substrate 4 in the illustrated embodiment. However, without being limited to this, the switching-control device 15 may be installed, for example, in a control part provided in a device on which the switch module 2 is mounted.

Figure 4:
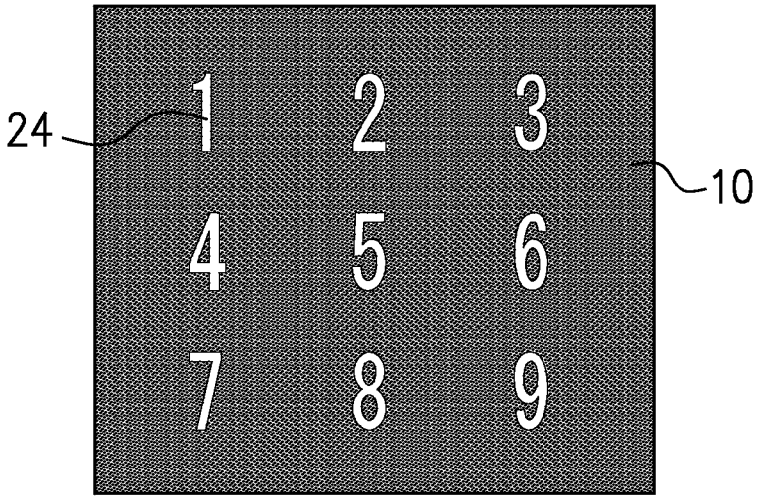
FIG. 4 is a plan view illustrating a second display that is illuminated by a second light-guiding sheet in the switch module shown in FIG. 1.

In the switch module 2 having the structure as mentioned above, when the second light sources 14 are lighted, the light emitted from the second light sources 14 enters the second light-guiding sheet 10 which is positioned upwardly through the end surface 10*a* thereof. Light that has entered the second light-guiding sheet 10 is guided by the second light-guiding sheet 10, diffused at each second display 24 comprising the light-diffusion layer and directed above the switches 6, as shown in FIG. 2. Consequently, a second display 24 corresponding to an operation position of the switch 6 is configured to emit light, for example, each second display 24 comprising the numbers and so on is illuminated and displayed at the operation position, as shown in FIG. 4.

Figure 5:
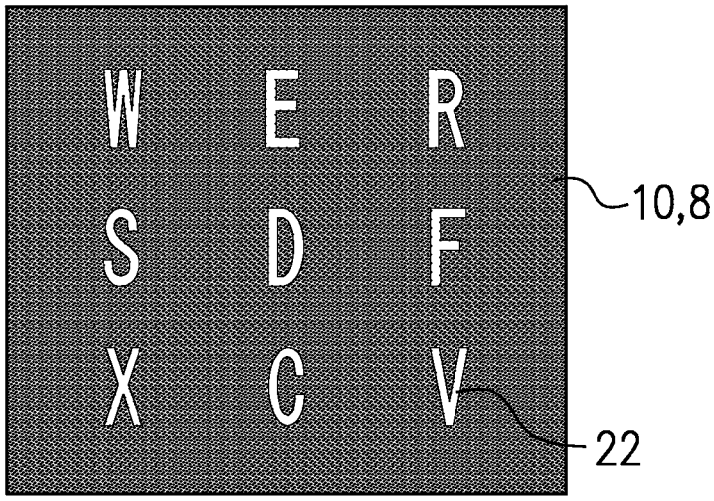
FIG. 5 is a plan view illustrating a first display that is illuminated by a first light-guiding sheet in the switch module shown in FIG. 1.

On the other hand, when the first light sources 12 are lighted, the light emitted from the first light sources 12 enters the first light-guiding sheet 8 which is positioned under the second light-guiding sheet 10 through the end surface 8*a*. The light that has entered the first light-guiding sheet 8 is guided by the first light-guiding sheet 8, reflected or diffused on the first display 22 comprising the light-diffusion layer formed by printing or the like and is directed above the switches 6, as shown in FIG. 3. At this time, the light reflected or diffused on the first display 22 passes through the second display 24 and the second light-guiding sheet 10 which are disposed above the first light-guiding sheet 8 and configured to allow transmission of light from underneath, and is thereby irradiated toward the outside. Consequently, a first display 22 corresponding to an operation position of the switch 6 is configured to emit light, for example, the first display 22 comprising the English characters and so on is illuminated and displayed at the operation position, instead of the second display 24, as shown in FIG. 5.

Figure 6A:
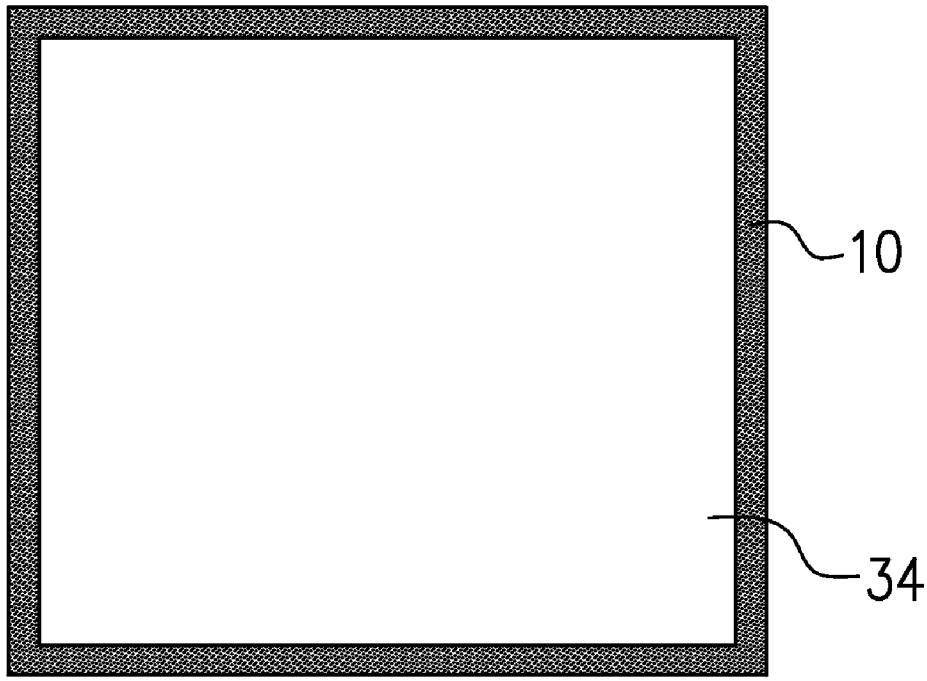
FIG. 6A is a top plan view showing a state where a colored layer is provided on a second light-guiding sheet in the switch module as shown in FIG. 1.
Figure 6B:
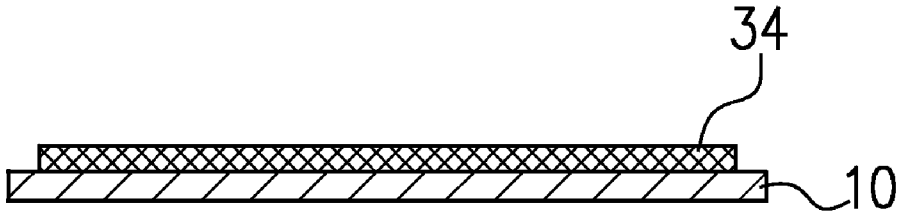
FIG. 6B is a sectional view of the second light-guiding sheet shown in FIG. 6A.

As mentioned above, by lighting the first light sources 12 or the second light sources 14, the first display 22 or the second display 24 can be selectively illuminated. However, there is a possibility that the first and second displays 22 and 24 can be faintly seen through the second and first light-guiding sheets 10 and 8 due to outside light or the like entering the switch module when the first and second light sources 12 and 14 are turned off. Therefore, a colored layer 34 formed by print with a paint having a high transmittance may be provided on the upper surface of the second light-guiding sheet 10 positioned upwardly, as shown in FIGS. 6A and 6B so that the first and second light-guiding displays 22 and 24 cannot be seen, except when lighted.

More specifically, in a case of providing the colored layer 34, if a color of the colored layer 34 is set to have a color close to a color of the first and second displays 22 and 24 faintly visible due to the outside light, because a background, or the colored layer 34 and the first and second displays 22, 24 have the same color, it is not possible to see the first and second displays 22 and 24, except when the first and second light sources 12 and 14 are lighted.

Figure 7A:
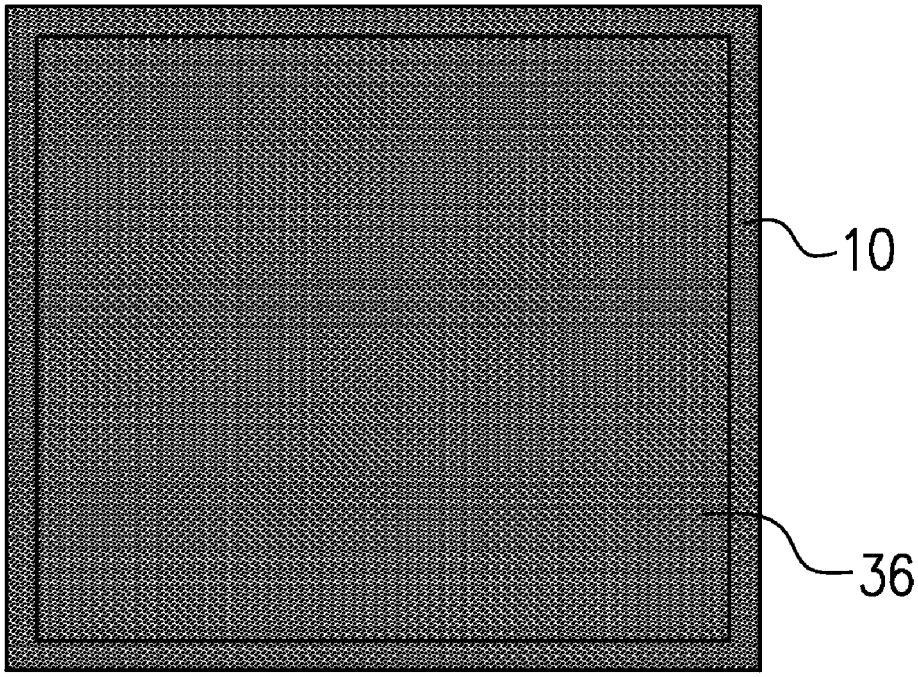
FIG. 7A is a plan view showing a state where a filter is provided on an upper surface of the second light-guiding sheet in the switch module as shown in FIG. 1.
Figure 7B:
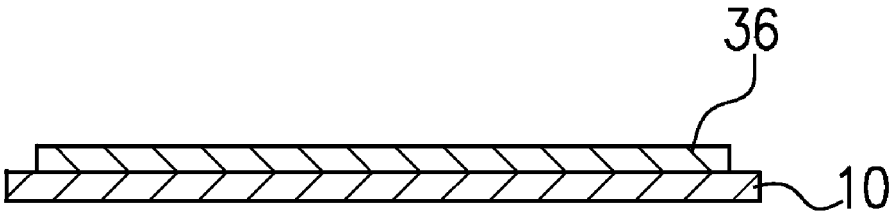
FIG. 7B is a sectional view of the second light-guiding sheet shown in FIG. 7A.

In addition, as shown in FIGS. 7A and 7B, a filter 36 such as a smoke filter or the like which shields light of the outside light reflected on the first and second displays 22 and 24 is disposed on the second light-guiding sheet 10, thereby completely preventing the first and second displays 22 and 24 from being seen, except when the first and second light sources 12 and 14 are lighted.

Meanwhile, to achieve an object that the first and second light-guiding sheets 8 and 10 separately guide light, it is preferable that the first and second light-guiding sheets 8 and 10 are disposed to be stacked in a state where they are slightly separated from each other without being closely fitted. In the embodiment, because the second displays 24 and a part of each of the light-shielding sheets 30, 32 are laid between the first and second light-guiding sheets 8 and 10, the first and second light-guiding sheets are prevented from being in close contact. Otherwise, a spacer or the like formed by printing or the like may be laid between the first and second light-guiding sheets 8 and 10.

It is also possible to display the first and second displays 22 and 24 together by lighting the first and second light sources 12 and 14 simultaneously in the case that the first and second displays 22 and 24 are not stacked.

On the other hand, in the aforementioned embodiment, the first and second displays 22 and 24 are provided on the lower surfaces of the first and second light-guiding sheets 8 and 10, respectively, but may be provided on the upper surfaces of the first and second light-guiding sheets 8 and 10, respectively.

Figure 8:
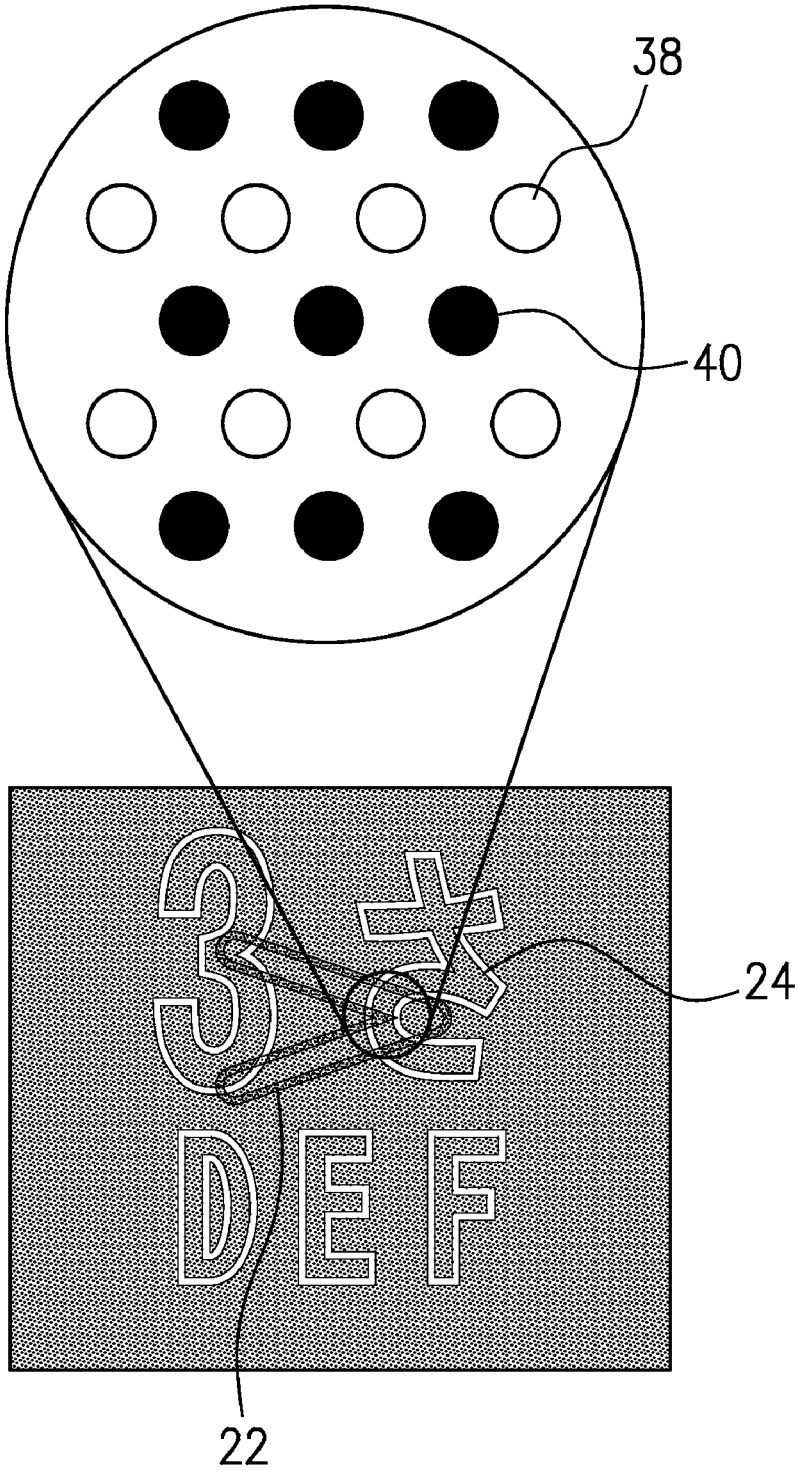
FIG. 8 is an explanatory view showing a state where the first display and the second display in the switch module as shown in FIG. 1 are partially enlarged.

Regarding the first and second displays 22 and 24, the upwardly positioned second displays 24 or both the first and the second displays 22 and 24 are formed in a dot pattern, shown in FIG. 8, whereby a display of each of the first and second displays 22 and 24 and both displays of the first and second displays can be made simultaneously. That is, as shown in FIG. 8, the upwardly positioned second displays 24 are formed in a dot pattern which is a collective of dots 38 (white circles in FIG. 8) each comprising such as an uneven layer, printing layer colored with diffusion white or the like, for diffusing light.

When the second displays 24 are formed in the dot pattern in this way, light diffused on the second displays 24 is displayed as a collective of the dots 38, and light diffused on the downwardly positioned first display 22 is displayed by transmitting between the dots 38.

The first displays 22 are formed in dots 40 (black circles in FIG. 8) similar to the dots 38 in the second displays 24. At least one of the marks of the first display and at least one of the marks of the second display have an overlapped portion, and dots in the overlapped portion of the first and second displays are displaced alternately in planar view. If the dot patterns are preferably disposed so that the dots 38 and 40 are alternately arranged to be displaced, it is possible to securely display together a portion where the dot patterns of the first and second displays 22 and 24 intersect. Thereby, it is possible to display the first and second displays 22 and 24 simultaneously.

In the switch module according to the present invention, in its essence, by switching a first light source provided to correspond to a first light-guiding sheet and a second light source provided to correspond to a second light-guiding sheet, either one of the first light source or the second light source can be lighted. For example, if the first light source is lighted, light emitted from the first light source illuminates the corresponding first light-guiding sheet, whereby a first display provided on the first light-guiding sheet is displayed, and if the second light source is lighted, light emitted from the second light source illuminates the corresponding second light-guiding sheet, whereby a second display provided on the second light-guiding sheet is displayed.

In this way, by switching lighting of the first light source and lighting of the second light source, either the first display or the second display can be selectively displayed. Consequently, it is possible to switch and display a plurality of displays for one key, thereby enabling a function of keys to be displayed distinctly.

Although the preferred embodiments of the present invention have been described, it should be understood that the present invention is not limited to these embodiments, other embodiments can be made, and various changes and modifications can be made to the aforementioned embodiments.

What is claimed is:

1. A switch module, comprising:

a substrate including an upper surface;

a plurality of switches provided on the upper surface of the substrate;

a first light-guiding sheet including an upper surface, a lower surface, and a peripheral edge between the upper surface and the lower surface, the first light-guiding sheet being disposed above the plurality of switches;

a second light-guiding sheet including an upper surface, a lower surface, and a peripheral edge between the upper surface and the lower surface, the second light-guiding sheet being layered above the first light-guiding sheet;

at least one first light source disposed on the upper surface of the substrate to emit light into the first light-guiding sheet through the peripheral edge of the first light-guiding sheet;

at least one second light source disposed on the upper surface of the substrate to emit light into the second light-guiding sheet through the peripheral edge of the second light-guiding sheet; and a illumination-control device switching on/off of the first light source and the second light source.

2. The switch module according to claim 1, further comprising a first display disposed adjacent to the first light-guiding sheet that guides light emitted from the first light source and a second display disposed adjacent to the second light-guiding sheet that guides light emitted from the second light source.

3. The switch module according to claim 1, wherein each of the plurality of switches includes a fixed contact provided on the upper surface of the substrate and a tact spring disposed on the upper surface of the substrate to cover the fixed contact.

4. The switch module according to claim 2, wherein the first display includes a plurality of marks and the second display includes a plurality of marks that are different from the marks of the first display, and both of the marks of the first display and the second display being positioned above the respective switches.

5. The switch module according to claim 4, wherein the marks of the second display are positioned above the marks of the first display, and wherein each of the marks of the second display comprises a light-diffusion layer that transmits light from the first light-guiding sheet that is positioned below the second display.

6. The switch module according to claim 4, wherein each of the marks of the second display comprises a plurality of dots.

7. The switch module according to claim 4, wherein each of the marks of the second display comprises a light-diffusion layer.

8. The switch module according to claim 2, further comprising a colored layer that transmits light being provided on at least one of the upper surface and the lower surface.

9. The switch module according to claim 2, further comprising a filter provided on the upper surface of the second light-guiding sheet.

10. The switch module according to claim 4, wherein each of the marks of both the first display and the second display comprises dots.

11. The switch module according to claim 3, further comprising an adhesive sheet that covers and holds the tact springs of the switches, and the adhesive sheet being adhered to the upper surface of the substrate.

12. The switch module according to claim 11, wherein at least one of the marks of the first display and at least one of the marks of the second display have an overlapped portion, and wherein dots in the overlapped portion of the first display and the second display are displaced alternately in top plan view.

13. The switch module according to claim 1, wherein the first and second light sources are disposed to face each other at opposite ends of the layered first and second light-guiding sheets.

14. The switch module according to claim 13, further comprising a first light-shielding sheet having one end and an other end that is opposite to the one end, wherein, the first light-shielding sheet is adhered to an upper surface of the first light source at the one end and adhered to the upper surface of the first light-shielding sheet at the other end.

15. The switch module according to claim 14, further comprising a second light-shielding sheet having one end and an other end that is opposite to the one end, wherein, the second light-shielding sheet is adhered to the upper surface of the substrate at the one end and adhered to the upper surface of the first light-shielding sheet at the other end.

16. The switch module according to claim 11, wherein the first display is provided on the upper surface of the adhesive sheet to be positioned above the plurality of switches.

17. The switch module according to claim 2, wherein the second display is provided on the upper surface of the first light-guiding sheet to be positioned above the plurality of switches.

18. The switch module according to claim 2, wherein the first display is provided on the first light-guiding sheet to be positioned above the plurality of switches.

19. The switch module according to claim 2, wherein the first display is provided on the second light-guiding sheet to be positioned above the plurality of switches.

* * * * *